United States Patent [19]

Fox, III

[11] Patent Number: 4,953,856

[45] Date of Patent: Sep. 4, 1990

[54] EXERCISE GARMENT

[76] Inventor: Charles E. Fox, III, 115 Ashford Pl., Greenwood, S.C. 29646

[21] Appl. No.: 324,729

[22] Filed: Mar. 17, 1989

[51] Int. Cl.[5] ..... A63B 21/065

[52] U.S. Cl. ..... 272/119; 2/69

[58] Field of Search ..... 272/119, 117, 70, 71, 272/93; 2/69

[56] References Cited

U.S. PATENT DOCUMENTS

| | | | |
|---|---|---|---|
| 3,759,510 | 9/1973 | Jackson, Jr. | 272/119 |
| 4,180,261 | 12/1979 | Kolka | 272/119 |
| 4,303,239 | 12/1981 | Walsh, Jr. | 272/119 |
| 4,382,302 | 5/1983 | Watson | 272/119 X |
| 4,384,369 | 5/1983 | Prince | 272/119 X |
| 4,407,497 | 10/1983 | Gracie | 272/119 |
| 4,585,228 | 4/1986 | Olson | 272/119 |
| 4,602,784 | 7/1986 | Budden et al. | 272/119 |
| 4,632,389 | 12/1986 | Moss | 272/119 |
| 4,658,442 | 4/1987 | Tomlinson et al. | 272/119 X |

FOREIGN PATENT DOCUMENTS

| | | | |
|---|---|---|---|
| 2492264 | 4/1982 | France | 272/119 |
| 428519 | 7/1967 | Switzerland | 272/119 |
| 1097350 | 6/1984 | U.S.S.R. | 272/119 |

*Primary Examiner*—Robert W. Bahr

*Attorney, Agent, or Firm*—Bailey & Hardaway

[57] ABSTRACT

By an exercise garment comprising a waistband, a pair of upper leg straps attached to the waistband for positioning about the thighs with weight attachments at the front of the thighs, a pair of lower leg straps for placement about the calves and providing for weight attachment in the back of the calves. An upper body strengthening suit complements the lower body suit and has provisions for weights up the spinal cord across the shoulders to the elbows. This is carried out through the use of an upper waist strap with a generally T-shaped portion having a T-base up the spine for the support of weights with a cap to the "T" crossing the shoulders extending to the elbows and provided for placement of weights therein. Shoulder straps attach the upper T cap across the shoulders down the front of the wearer back to the upper waist strap for support thereof.

4 Claims, 2 Drawing Sheets

EXERCISE GARMENT

BACKGROUND OF THE INVENTION

This invention relates generally to the art of exercise and, more particularly, to the art of exercising and providing proper form while exercising, running or walking.

A variety of exercise devices have been produced over recent history to be utilized for body building purposes and to otherwise enhance exercise efforts. Generally weighted anklets or bracelets have utilized by runners to enhance the efforts during running exercises as well as to provide additional strengthening of the muscles involved. One such device is described in U.S. Pat. No. 3,532,339.

A variety of divers' weights have been utilized as well to overcome the natural buoyancy of a human body in the water. This is described in, for example, in U.S. Pat. No. 3,713,299.

The concepts of exercising and weighted divers' weights are combined in U.S. Pat. No. 4,329,211.

Russian Patent No. SU 1,097,350 describes an exercising method wherein a variety of weights are placed upon the body so as to distribute impact forces simultaneously between all muscles centers.

A weighted exercise suit is described in U.S. Pat. No. 4,407,497.

While the above exemplifies the multitude of exercise aiding devices, no single device has filled the need of correcting form as well as providing exercise enhancement.

SUMMARY OF THE INVENTION

It is thus an object of this invention to provide a novel exercise garment.

It is a further object of this invention to provide a novel exercise garment which improves exercise form during movement such as running and walking.

It is a further and more particular object of this invention to provide an exercise garment which may have a variety of weights attached thereto so as to provide a single suit which may be used through a variety of fitness and form levels.

These, as well as other objects, are accomplished by an exercise garment comprising a waistband, a pair of upper leg straps attached to the waistband for positioning about the thighs with weight attachments at the front of the thighs, a pair of lower leg straps for placement about the calves and providing for weight attachment in the back of the calves. An upper body strengthening suit complements the lower body suit and has provisions for weights up the spinal cord across the shoulders to the elbows. This is carried out through the use of an upper waist strap with a generally T-shaped portion having a T-base up the spine for the support of weights with a cap to the "T" crossing the shoulders extending to the elbows and provided for placement of weights therein. Shoulder straps attach the upper T cap across the shoulders down the front of the wearer back to the upper waist strap for support thereof.

DETAILED DESCRIPTION OF THE DRAWINGS

In accordance with this invention it has been found that a exercise garment may be provided which not only enhances the benefits of exercise but promotes proper form in so doing. The strengthening garment in accordance with this invention provides for balance and symmetry such that any movement off balance is greatly exagerated causing the user thereof to correct errors in form.

The placement of weights enhances the strengthening of the muscles utilized in walking and running while simultaneously correcting and improving form. Many other advantages and features will become apparent from a reading of the following description given with reference to the various figures of drawing.

Figure 1:
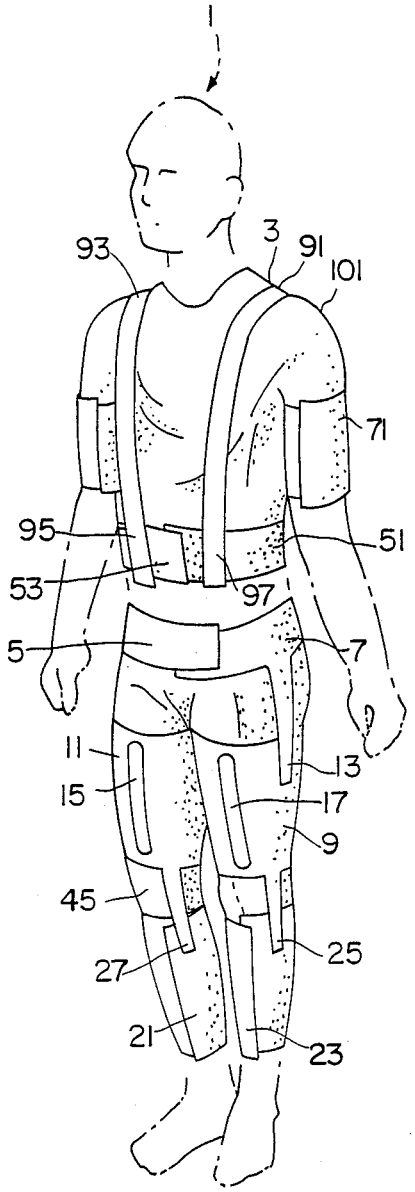
FIG. 1 of the drawings is a front view of the strength suit in accordance with this invention upon a user.
Figure 2:
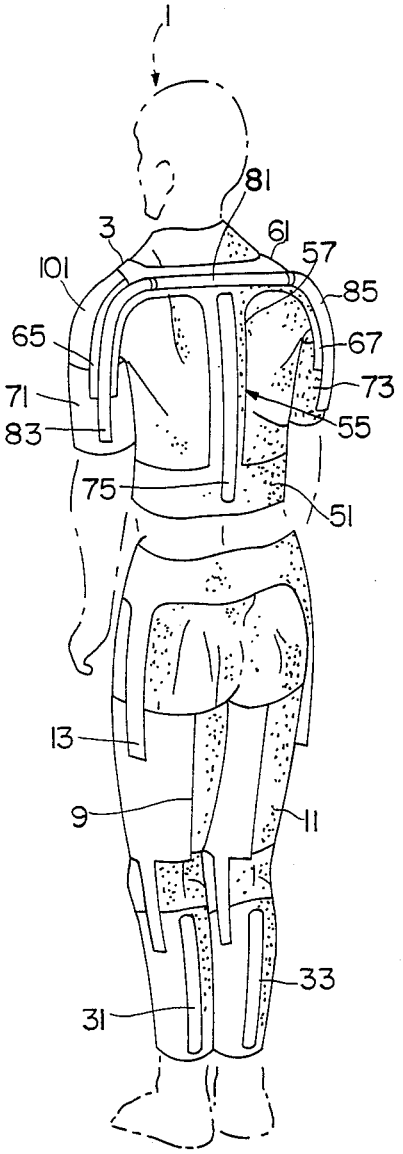
FIG. 2 of the drawings is a rear view of an individual with the strength suit of this invention thereon.

As illustrated in FIG. 1, a user 1 is shown at front view wearing exercising garment in accordance with this invention. The garment is divided into an upper body portion 3 and a lower body portion 5 which will be described independently of one another beginning with the lower body portion 5.

Lower body portion 5 comprises a waistband 7 which wraps about the waist and is secured in place by VELCRO (not shown in this view) in the overlapping frontal portion. The waistband 7 is attached to upper leg straps 9 and 11 also through the use of VELCRO and supporting elements. The upper leg straps have positions 15 and 17 for the placement of weights along the hamstring by a technique to be further described.

The upper leg straps are attached to lower leg straps 21 and 23 by suspending elements 25 and 27 through the use of VELCRO. The lower leg straps are also attached by means of VELCRO to provide for appropriate positioning. The lower leg straps have positions for weights 31 and 33 in the back of the calf portion. The three major elements, the waistband, the upper leg straps and lower leg straps are preferably formed of neoprene so as to be snugly fitted. The areas beneath the neoprene may be a part of a spandex bodysuit as illustrated at 45.

In general the weights on the front of the thighs make the user pump the legs harder than normal. The actual muscle used to pump the legs are strengthened thus helping the runner with knee lift and running form.

The weights on the back of the calves make the user push off harder on each stride. The weights help the runner increase stride length.

The upper bottom portion 3 comprises an upper waist strap 51 which attaches to itself through the use of VELCRO (not shown in this view) as at 53. The upper waist strap 51 joins a generally T-shaped section 55 which has the leg of a "T" at 57 generally following the contour of the spine with the cap of the "T" 61 extending across the shoulder and down the arms to the elbow terminating generally as illustrated at 65 and 67 where the T-cap merges with and is attached to arms straps 71 and 73. It is seen that a weight 75 is attached to the T-leg section 57 and extends up the spinal cord. The T-cap section supports shoulder weights 81 and arm weights 83 and 85. These arm weights are held in position by arm straps 71 and 73 as well as suspender shoulder straps 91 and 93 which attach to the front of the upper waist belt 51 at 95 and 97 by VELCRO. The upper body portion may also have a spandex underpinning as at 101 so as to isolate the neoprene from the skin surface.

The top weights are balanced in to be symmetrical with the spine to cause a runner who runs off balance or with to much motion from side to side to feel the imbalance. The weights will exaggerate this mistake forcing the user of the garment to correct this error so as to be able to move with less effort. The weights on the back of the arms make the runner pump the arms harder than normal. The actual muscles used in pumping the arms are strengthened thus also enhancing form.

Figure 3:
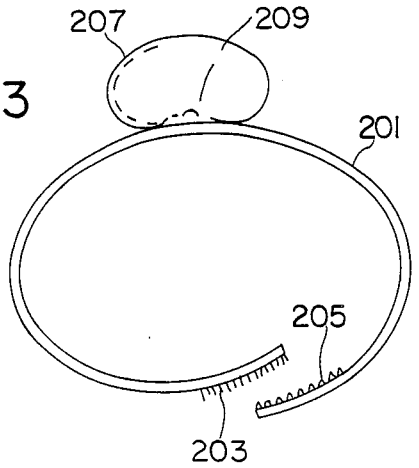
FIG. 3 of the drawings is a top view of a weighted strap in accordance with this invention.
Figure 4:
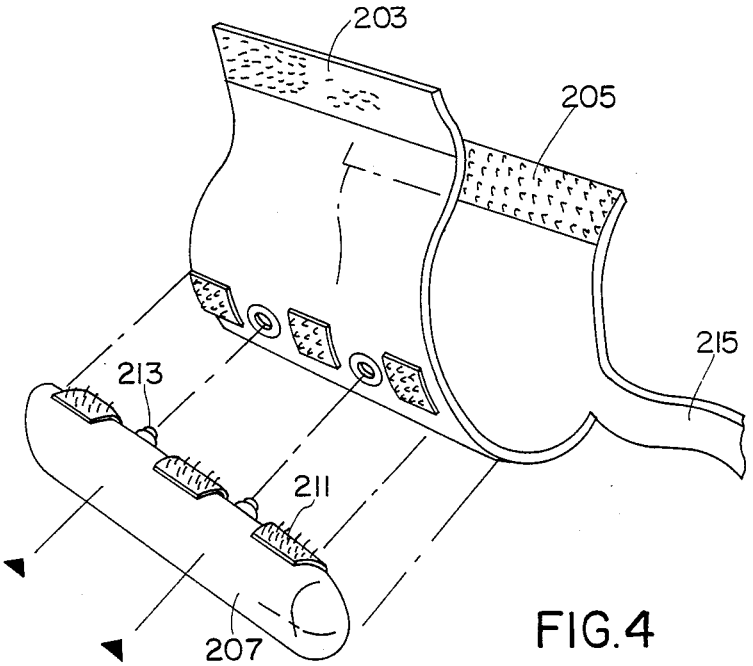
FIG. 4 is a view similar to FIG. 3 showing a strap and weight in accordance with this invention in an assembly view.

FIG. 3 of the drawings shows a typical strap 103 used in accordance with this invention. All straps are of similar construction such that the strap 201 exemplifies any of the upper leg straps, lower leg straps, waist straps or upper waist straps for attachment purposes. The strap 201 has VELCRO sections 203 and 205 so that it may be easily secured about a body member. A weight holding element 207 is illustrated and is attached at 209. The straps are as previously indicated preferably of an elastomeric material such as neoprene. The weight element 207 as better illustrated in FIG. 4 is simply a sewn pouch filled with sand, beans or B-B's with weights which may vary from 5 to 10 pounds. The weight 207 has attachment means as at 211 to attach by VELCRO segments and may also include mechanical snaps 213. Also shown in FIG. 4 is a suspending strap to 15 which would also include VELCRO for attachment in a particular location. It is noted that all weighted sections are flexible so as to cause no impairment of body movement while simultaneously improving the form thereof.

It is thus seen that the exercise garment in accordance with this invention provides not only for strengthening of the user thereof, but provides for improvement of form due to the symmetrical arrangement thereof. As many variations will become apparent from a reading of the above description, which is exemplary in nature, such variations are embodied within the spirit and scope of this invention as defined by the following appended claims.

That which is claimed is:

1. An exercise garment comprising:

an elastomeric waistband;

a pair of upper leg straps for placement about the thigh; said upper leg straps being attached to said waistband;

removeably secured weights on the front portion of said upper leg straps positioned on the front of a runner wearing said suit;

a pair of lower leg straps suspended from said upper leg straps said lower leg straps having a position for removeably securing weights to the back leg portion of a runner;

an upper waist strap to encircle the waist of a runner;

a generally T-shaped member extending from said upper waist strap up the spinal area of the runner to the shoulder portion and extending in a T-like fashion from the shoulders down the backs of the arm to the elbow;

said generally T-shaped member having a weight removeably secured to leg of the "T" extending generally up the spinal portion of the user;

weights removeably secured to the cap portion of the "T" extending to the elbows of the user; and suspender shoulder straps extending from the upper portion of the "T" back to the waistband to maintain weights in proper position.

2. The exercise garment according to claim 1 further comprising arm straps in communication with the T-cap extensions of said T-shaped member for supporting weights thereon.

3. The weighted garments in accordance with claim 1 wherein said weights are removably attached to the suit.

4. The garment in accordance with claim 3 wherein said weights comprise a neoprene container housing weights therein.

* * * * *